United States Patent [19]

Nolan, Jr. et al.

[11] 3,953,323

[45] Apr. 27, 1976

[54] PROCESS FOR REDUCTION OF OLEFINIC UNSATURATION OF PYROLYSIS NAPHTHA (DRIPOLENE)

[75] Inventors: John T. Nolan, Jr., Wappingers Falls; Raymond F. Wilson, Fishkill, both of N.Y.

[73] Assignee: Texaco Inc., New York, N.Y.

[22] Filed: Dec. 23, 1974

[21] Appl. No.: 535,315

[52] U.S. Cl. ..... 208/255; 208/211; 260/683.9

[51] Int. Cl.[2] ..... C10G 23/02; C07C 5/02

[58] Field of Search ..... 208/255, 298

[56] References Cited

UNITED STATES PATENTS

| | | | |
|---|---|---|---|
| 1,864,583 | 6/1932 | Coubrough | 208/255 |
| 2,238,429 | 4/1941 | Brandt | 208/255 |
| 2,402,799 | 6/1946 | Arnold et al. | 208/255 |
| 3,108,947 | 10/1963 | Stijntjes | 208/255 |

*Primary Examiner*—Delbert E. Gantz
*Assistant Examiner*—G. J. Crasanakis
*Attorney, Agent, or Firm*—Thomas H. Whaley; Carl G. Ries; Carl G. Seutter

[57] ABSTRACT

A process is herein disclosed for decreasing olefin and diolefin unsaturation of pyrolysis naphtha (dripolene) without concomitant production of gum, heavy polymers, and/or coke; which process comprises treating pyrolysis naphtha with water at a temperature in the range of 500°–700°F at an elevated pressure in the range of 700–4000 psig for a residence time of from about 12 minutes to about 10 hours under conditions such that a portion of the treating water remains in the liquid phase. Treated naphtha product from said treating step, substantially reduced in olefinic and diolefinic unsaturation and essentially free of gum, heavy polymers and coke, may be hydrotreated with molecular hydrogen in the presence of a hydrogenation catalyst for further reduction of olefinic and diolefinic unsaturation and removal of sulfur compounds.

12 Claims, No Drawings

PROCESS FOR REDUCTION OF OLEFINIC UNSATURATION OF PYROLYSIS NAPHTHA (DRIPOLENE)

BACKGROUND OF THE INVENTION

1. Field of the Invention

The present invention relates to methods of treating pyrolysis naphtha for reduction of olefinic and diolefinic unsaturation. More particularly the present invention relates to a process for reducing olefinic and diolefinic unsaturation of pyrolysis naphtha under conditions such that formation of gum, heavy polymers and coke is substantially reduced. In particular, the present invention relates to a method for treating pyrolysis naphtha prior to a hydrogenation process or other refining process, such that fouling of process equipment and deactivation of catalyst by gum, heavy polymers and/or coke is substantially eliminated.

Pyrolysis naphtha, such as that obtained as byproduct from hydrocarbon cracking processes for production of ethylene, consists of a mixture of highly unsaturated hydrocarbons. Hydrocarbon species represented in pyrolysis naphtha include aromatic hydrocarbons, polynuclear aromatic hydrocarbons, olefin and diolefin substituted aromatic hydrocarbons, olefinic hydrocarbons, diolefin hydrocarbons, etc. Commonly, such pyrolysis naphtha may comprise about 90 percent or greater hydrocarbons containing aromatic nuclei. Such pyrolysis naphtha has a very high octane blending value, and upon stabilization to prevent gum and/or heavy polymer formation is particularly useful as a gasoline blending component. Additionally, pyrolysis naphtha is a source of aromatic hydrocarbons which are valuable as solvents, chemical raw materials, etc.

2. Description of the Prior Art

Pyrolysis naphtha, because of its high degree of olefinic and diolefinic unsaturation, is a highly unstable material and upon exposure to elevated temperatures forms gums, heavy polymers and/or coke-like materials. Consequently, in processes of the prior art for treating such pyrolysis naphtha, particularly hydrotreating processes, equipment and catalyst tend to become fouled with such gums, heavy polymers and coke. Additionally, gasoline blends employing untreated pyrolysis naphtha have high gum contents which can cause engine fouling upon use as a motor fuel. It is highly preferable that pyrolysis naphtha be hydrotreated for saturation of reactive olefinic and diolefinic compounds, as well as removal of sulfur compounds which may be present, prior to other refining processes. However, due to the gum and heavy polymer forming tendency of the pyrolysis naphtha upon exposure to elevated temperatures, hydrotreating catalysts exposed to untreated pyrolysis naphtha becomes rapidly deactivated and fouled.

In the prior art, processes for treating pyrolysis naphtha prior to hydrotreating or other processing are known. One process comprises contacting pyrolysis naphtha with clay absorbent for absorption of olefin and diolefin hydrocarbons. Although this process is effective for removal of such olefin and diolefin hydrocarbons, it has a disadvantage in that the clay absorbents must be either regenerated or disposed of. Furthermore, a substantial proportion of the pyrolysis naphtha is lost by absorption into the clay.

Another process for treating pyrolysis naptha is taught in U.S. Pat. No. 3,400,169, Eng et al. (1968). In this treating process, pyrolysis naphtha is contacted with silica-alumina cracking catalyst for polymerization of diolefins, and subsequently, the pyrolysis naphtha cracking catalyst mixture is passed into a catalytic cracking zone wherein the polymers formed are cracked into lower boiling hydrocarbons. While this process appears effective for reducing the diolefinic unsaturation of the pyrolysis naphtha, it is a two-step process and the silica-alumina catalyst must be either regenerated or disposed of in some manner.

Another process for treating pyrolysis naphtha is disclosed in U.S. Pat. No. 3,788,979, Caflisch et al. (1974). This process for treating pyrolysis naptha comprises separating the pyrolysis naphtha into a light fraction and a heavy fraction, cracking the light fraction thus producing monomers corresponding to polymers present in the pyrolysis naphtha; hydrogenating said cracked light fraction for saturation of olefinic hydrocarbons; and recovering the high octane blending component from said hydrogenated product. The disadvantage of this process includes loss of a substantial portion of the pyrolysis naphtha which is higher boiling than the light fraction recovered for treatment.

SUMMARY OF THE INVENTION

Now, according to the method of the present invention, an improved process for treating pyrolysis naphtha prior to subsequent refining processes is disclosed.

THE METHOD OF THE PRESENT INVENTION

Comprises treating pyrolysis naphtha with water at a temperature in the range of about 500° to 700°F, for a time of from about 12 minutes to about 10 hours or more, and at a pressure in the range of about 690 to about 4000 psig sufficient to maintain a substantial portion of the water in the liquid phase. Subsequent to this treatment, treated pyrolysis naphtha and water are separated by liquid-liquid separation means. The separated treated pyrolysis naphtha is then available for further processing, such as hydrogenation. The separated water phase, if desired, may be recycled for treatment of additional pyrolysis naphtha.

In one embodiment of the present invention treated pyrolysis naphtha, upon separation from the water, is hydrogenated for additional reduction of olefinic and diolefinic unsaturation under hydrogenation conditions wherein substantially no hydrogenation of aromatics occurs.

When treated according to the method of the present invention, olefinic and diolefinic unsaturation pyrolysis naphtha is substantially decreased under conditions such that gum, heavy polymers and coke are not formed in any substantial amount.

Another advantage of the process of the present invention is the treating medium, water, may be recycled for contact with additional pyrolysis naphtha. Consequently, disposal of a large amount of treating medium is unnecessary. Should it be desired, a slip stream of the treating water may be withdrawn and disposed of by such means as incineration in an efficient, nonpolluting manner. These advantages are well as other will be more completely described in the detailed description of the invention which follows.

DETAILED DESCRIPTION OF THE INVENTION

Pyrolysis naphtha charge stocks within the contemplation of the present invention are those obtained from pyrolitic cracking of hydrocarbons. Such pyrolysis naphthas are highly unsaturated, comprising aromatic, polynuclear aromatic, olefinic, diolefinic, olefin substituted aromatic, etc., hydrocarbons. Such pyrolysis naphthas are very unstable, and upon the addition of heat diolefinic compounds present therein tend to polymerize forming gum, heavy polymers, and coke. As a consequence, untreated pyrolysis naphtha when charged to refining processes, such as hydrogenation processes, tend to foul and/or plug process equipment and deactivate catalyst. A common source for pyrolysis naphtha is steam-cracking of hydrocarbons for the production of low molecular weight olefins, such as ethylene. In such steam cracking processes, charge stock hydrocarbon at low pressure in the presence of steam is heated to a high temperature for a short time whereupon the hydrocarbon charge stock is cracked substantially into low molecular weight olefins, particularly ethylene. A byproduct of such steam cracking processes is pyrolysis naphtha which generally comprises about 90 percent or greater aromatic containing hydrocarbons with the remainder essentially comprising olefin and diolefin hydrocarbons. Charge stocks to a steam cracking process may vary from ethane to gas oils in boiling range. Although pyrolysis naphtha is a by-product of such steam cracking processes whatever hydrocarbon is chosen as charge stock, more pyrolysis naphtha is produced from processes employing the heavier charge stocks. In the method of the present invention, pyrolysis naphtha obtained as by-products from steam cracking processes are contemplated to be the major charge stocks. However, any naphtha boiling range hydrocarbon containing substantial amount of reactive olefinic hydrocarbons may be processed according to the method of this invention.

According to the method of the present invention, pyrolysis naphtha is treated with water under conditions of elevated temperature and pressure for reduction of olefinic and diolefinic unsaturation without substantial formation from gum, heavy polymers and/or coke. Water which may be used in the process of the present invention need not be pure or distilled water; well water or clarified surface water may be used to advantage. In one embodiment of the present invention it is desirable that treating water, upon separation from treated pyrolysis naphtha, be recycled for treatment of additional pyrolysis naphtha. Such recycle water may contain small amounts of hydrocarbons dissolved or entrained therein. Within contemplation of the present invention pyrolysis naphtha is treated with water in an amount wherein a substantial amount of liquid water is present under the temperature and pressure conditions of the process. Pyrolysis naphtha to water ratios of from about 3:1 to about 0.5:1 may be employed. At pyrolysis naphtha to water ratios above about 3:1 sufficient liquid water may not be present for adequate treatment of the naphtha. At ratios less than 0.5:1 no additional benefit is to be obtained from the excess water.

Pyrolysis naphtha treating temperatures effective for substantially reducing olefinic unsaturation without formation of substantial amounts of gum, heavy polymers, and/or coke are temperatures within the range of about 500°–700°F. Temperatures of about 700°F are preferred as the reduction of olefinic hydrocarbons increases with increasing temperatures within the 500°–700°F range. Temperatures above 700°F are not recommended, for at 750°F a substantial proportion of the pyrolysis naphtha is converted into a solid carbonaceous material (coke). At temperatures below about 500°F, reduction of olefinic hydrocarbons under conditions of the present invention is not substantial.

According to the treating method of the present invention a portion of the water is maintained in the liquid phase at the selected treated temperature in the 500°–700°F range. Consequently, superatmospheric pressure must be maintained in the reaction zone wherein the pyrolysis naphtha is being treated. Pressures of from about 681 psig to about 3500 psig, sufficient to maintain a portion of the water in the liquid phase at a selected temperature within the 500°–700°F range, may be employed in the process of the present invention. Preferably, the pressure employed is the equilibrium pressure of the pyrolysis naphtha-water mixture at the treating temperature. Application of additional pressure from some external source is not required. In order for a portion of the water to remain liquid under conditions of equilibrium pressure at the treating temperature selected, the volume of the reaction zone must be limited in relation to the volume of pyrolysis naphtha-water reaction mixture being treated. Preferably, the ratio of reactor volume to pyrolysis naphtha-water mixture is in the range of from about 2:1 to about 5:1 reactor volumes/volume liquid reaction mixture.

Residence time of the pyrolysis naphtha-water mixture within the reaction zone under treating conditions may be in the range from about 12 minutes to about 10 hours or more. Preferably, residence time is from about 1 to 10 hours. Under treating conditions of the present invention, increased residence time results in additional reduction of olefinic hydrocarbons. At residence times below about 12 minutes, reduction of olefinic hydrocarbons is not substantial. At residence times above about 10 hours, the rate of reduction of olefinic hydrocarbon decreases. Additional residence time in excess of about 10 hours may not be economically attractive. Residence time of from about 1 to 10 hours results in reduction of olefinic hydrocarbons to a degree sufficient for further processing of the treated pyrolysis naphtha without creating undue problems of fouling and catalyst deactivation in subsequent process systems.

The process of the present invention may be carried out in a batch treating step or a continuous process. In a batch treating step, a reaction vessel, such as an autoclave, may be employed. For a continuous process, a reaction zone such as a stirred-tank reactor capable of withstanding the required reaction pressures may be employed as well as other reaction zone configurations, such as tubular reactors.

Upon completion of the treating step, the reaction mixture of treated pyrolysis naphtha and water is cooled, by cooling means such as a heat exchanger, to a temperature at which essentially all the normally liquid components of the treated pyrolysis naphtha are condensed. This cooling step may be accomplished at ambient or superatmospheric pressures. Upon condensing the treated pyrolysis naphtha, the reaction mixture is separated by liquid-liquid separation means into a treated pyrolysis naphtha phase and a water phase. Such separation may be accomplished in any convenient liquid-liquid separation means, such as for example, centrifuge, settling tank, etc. From the liquid-liquid separation means, pyrolysis naphtha substantially free of water is recovered for further processing, such as for example, hydrogenation, gasoline blending, aromatic extraction, etc. The separated water phase from the liquid-liquid separation means may be removed from the process for disposal or, preferably, may be recycled to the reaction zone for contact with additional pyrolysis naphtha. The treated pyrolysis naphtha, upon separation from the water phase, is substantailly reduced in olefin and diolefin unsaturation and is substantially free of gum, heavy polymers and coke which may cause catalyst deactivation or fouling in downstream processing equipment.

Preferably, and according to one embodiment of the present invention, treated pyrolysis naphtha is subjected to hydrogenation prior to any further processing such as aromatic extraction or gasoline blending. The water treated pyrolysis naphtha of the present invention still possesses some degree of olefinic and diolefinic unsaturation. Additionally, such treated pyrolysis naphtha may contain sulfur compounds which were present in the pyrolysis naphtha charge entering the treating process. Consequently, the hydrogenation step is preferred for saturating a substantial proportion of the remaining olefinic and diolefinic unsaturation and for removal of sulfur from said treated pyrolysis naphtha. The hydrogenation step contemplated within the present invention is not so severe as to saturate any substantial portion of the aromatic hydrocarbons in the treated pyrolysis naphtha. For example, the treated pyrolysis naphtha may be contacted with molecular hydrogen at a rate of about 200–3000 scf/bbl at a temperature of about 400°–700°F and a pressure of from about 200–2000 psig in the presence of a hydrogenation catalyst at a liquid hourly space velocity (LHSV) of about 0.5–5 vol/vol/hr. The hydrogenation catalyst may be selected from any catalyst suitable for saturation of olefinic and diolefinic hydrocarbons and for conversion of sulfur compounds. For example, the hydrogenation catalyst may be selected from metals of Group VIII and Group VI-B of the Periodic Table of Elements, their oxides, their sulfides and mixtures thereof. Such hydrogenation catalysts may be unsupported or supported upon a refractory inorganic base such as silica-alumina, alumina, etc. For example, the hydrogenation catalyst may be selected from platinum; cobalt-molybdenum; nickel-tungsten; nickel-cobalt-molybdenum; etc. Preferably platinum and noble metal catalysts are supported upon an inorganic oxide base such as alumina, silica-alumina, etc. The non-noble hydrogenation catalysts are also preferably supported upon an inorganic oxide base and preferably converted to their sulfide form prior to use as a hydrogenation catalyst.

The following examples demonstrate the effectiveness of the treating method of the present invention for reducing olefinic and diolefinic unsaturation of pyrolysis naphtha without producing substantial amounts of gum, heavy polymers and coke. These example are for illustration only are not to be considered as limiting the scope of the present invention, which is set out in the appended claims.

EXAMPLE I

In this example, pyrolysis naphtha obtained from a commercial ethylene plant was treated with water according to the process of the present invention at a range of temperatures from 500°F to 800°F. Each run of this example was performed in a 1600 milliter rocking autoclave equipped with heating coils and pressure tight cover. Upon completion of each run, for the time specified, the reaction mixture was cooled to about ambient temperature, pressure was relieved, and the reaction mixture was passed into a separatory funnel. In the separatory funnel the reaction mixture separated in a water phase and a treated pyrolysis naphtha phase. Pyrolysis naphtha, substantially free of water, was recovered from the separatory funnel for analysis to determine the effectiveness of the treating method for reduction of olefinic and diolefinic unsaturation. Properties of the pyrolysis naphtha charge stock used in this example are shown in Table 1 following:

TABLE 1

| PRYOLYSIS NAPHTHA | |
|---|---|
| Gravity, °API | |
| (1)Bromine No. | 80 |
| (2)Diene No. | 5.4 |
| FIA Analysis | |
| Aromatics, Vol.% | 93.5 |
| Olefins, Vol.% | 6.5 |
| Saturates, Vol.% | 0 |
| Sulfur, % X-Ray | 0.005 |
| ASTM Gum, Mg/100 ml | 541 |

(1)Bromine number is determined by ASTM test D-1159, and is indicative of the degree of total olefinic unsaturation present in a hydrocarbon sample.

(2)Diene number is indicative of the number of reactive conjugated double bonds present in a hydrocarbon sample. The diene number is determined by reacting a known amount of maleic anhydride with a hydrocarbon sample, then back titrating with a standard base to determine the amount of maleic anhydride which has reacted. Maleic anhydride reacts with compounds having reactive conjugated double bonds (di-olefins, styrenes, etc) to form an adduct, but does not react with cumulative or isolated double bonds. However, since olefins having conjugated double bonds are more stable than olefins having cumulative or isolated double bonds, a demonstration that the number of conjugated double bonds has been reduced is considered to be sufficient as an indication that more reactive cumulative and isolated double bonds have likewise been reduced.

In the runs of this example, pyrolysis naphtha was treated with water at temperatures of from 500°F to 800°F for times ranging from 1 to 10 hours. Operating conditions and test results for the runs of this example are shown in Table 2 following:

TABLE 2

| TREATING PYROLYSIS NAPHTHA | | | | | | |
|---|---|---|---|---|---|---|
| Run No. | 1 | 2 | 3 | 4 | 5 | 6 |
| Pyrolysis Naphtha | | | | | | |
| Chg. ml | 300 | 300 | 300 | 500 | 300 | 300 |
| Gravity, API | 34.5 | 34.5 | 34.5 | 34.5 | 34.5 | 34.5 |
| Bromine No. | 80 | 80 | 80 | 80 | 80 | 80 |
| Diene No. | 5.6 | 5.6 | 5.6 | 5.6 | 5.6 | 5.6 |
| Coke, wt.% chg. | 0 | 0 | 0 | 0 | 0 | 0 |
| Water, ml | 100 | 100 | 100 | 100 | 100 | 100 |
| Naphtha/water vol ratio | 3/1 | 3/1 | 3/1 | 5/2 | 3/1 | 3/1 |
| Reactor vol, ml | 1600 | 1600 | 1600 | 1600 | 1600 | 1600 |
| Temp, °F | 500 | 600 | 700 | 700 | 750 | 800 |
| Pressure, psig | e'g'm | e'q'm | 3400 | 3400 | e'q'm | e'q'm |
| Residence time, hrs. | 1 | 1 | 1 | 10 | 1 | 1 |
| Treated Naphtha Product | | | | | | |
| Gravity, °API | 27.6 | 26.3 | 26.3 | 26.3 | — | — |
| Bromine No. | 59.3 | 43.9 | 28.0 | 15.4 | — | — |
| Diene No. | 3.7 | 3.0 | 2.4 | 1.8 | — | — |
| Coke, wt.% | 0 | 0 | 0 | 0 | 18 | 25 |

From an examination of Runs 1–4 of Table 2 it is seen that upon treating pyrolysis naphtha with water at temperatures of from 500°–700°F and at high pressures sufficient to maintain a portion of the water in liquid phase, total olefinic unsaturation as indicated by the Bromine number and conjugated diolefinic unsaturation as indicated by the Diene number is substantially reduced. Further, it is seen that olefinic and conjugated diolefinic unsaturation is increasingly reduced as the temperature is increased from 500°F to 700°F. Comparing Runs 3 and 4 of Table 2 it is also seen that by increasing the residence time from 1 to 10 hours at 700°F the total olefinic and conjugated diolefinic unsaturation is reduced even further with increased residence time. Examining now Runs 5 and 6 of Table 2 it is seen that as the reaction temperature was raised progressively to 750°F and 800°F, the pyrolysis naphtha reacted to form a solid carbonaceous material (coke) A temperature of 750°F is above the critical temperature of water (~705°F). Consequently, temperatures substantially above about 700°F result in conversion of a substantial portion of the pyrolysis naphtha into coke and other heavy polymers.

EXAMPLE II

In this example comparative runs of hydrogenation of treated and untreated pyrolysis naphtha were made to demonstrate the effectiveness of the treating method of the present invention. In Run 1, pyrolysis naphtha was treated with water at 700°F for 10 hours according to the method of the present invention in the apparatus described in Example I. Upon completion of the water treatment, treated pyrolysis naptha was separated from the water phase and was subjected to hydrogenation for further reduction of olefinic and conjugated diolefinic unsaturation. In Run 2 of this example, untreated pyrolysis naphtha was subjected to hydrogenation under the same conditions employed for hydrogenation of the water treated pyrolysis naphtha of Run 1. Operating conditions and results of these two comparative runs are shown in Table 3, following:

TABLE 3

| HYDROGENATION OF PYROLYSIS NAPHTHA | | |
|---|---|---|
| Run No. | 1 | 2 |
| Pyrolysis Naphtha Chg. | | |
| Gravity, °API | 34.5 | 34.5 |
| Bromine No. | 79 | 79 |
| Diene No. | 5.6 | 5.6 |
| Naphtha Water Treatment | | |
| Naphtha/water vol. ratio | 500/200 | (None) |
| Temp, °F | 700 | — |
| Pressure, Psig | 3,400 | — |
| Residence Time, hrs. | 10 | — |
| Treated Naphtha | | |
| Gravity, °API | 27.2 | — |
| Bromine No. | 15.4 | — |
| Diene No. | 1.8 | — |
| Hydrogenation | | |
| Temp., °F | 600 | 600 |
| $H_2$ Pressure, psig | 900 | 900 |
| gm catalyst/l gm naphtha | 50/500 | 50/300 |
| Hydrogenated Naphtha | | |
| Gravity, °API | 26.2 | 26.6 |
| Bromine No | 3.0 | 22 |
| Diene No | 0.7[1] | 0.83 |
| Yield (wt.% pyrolysis naphtha chg) | 92 | — |

[1]Catalyst employed was a Co-Mo hydrogenation catalyst sold by American Cyanamid under the tradename "AERO HDS-3."

In Table 3, it is seen that for Run 1, wherein water treated pyrolysis naphtha is subjected to hydrogenation, the Bromine number of the hydrogenated naphtha product is reduced to 3.0 while in Run 2, wherein untreated pyrolysis naphtha was subjected to hydrogenation, the Bromine number remains relatively high at 22. Consequently, treating pyrolysis naphtha according to the method of the present invention prior to a hydrogenation step results in a hydrogenated naphtha of much reduced total olefinic unsaturation. Additionally, the diene number of hydrogenated treated naphtha of Run 1 is reduced to 0.7, compared to a diene number of 0.83 for hydrogenating pyrolysis naphtha in Run 2.

Thus, as can be seen from the preceding discussion and Examples treatment of pyrolysis naphtha with water at temperatures in the range of 500°–700°F at high pressure results in the substantial reduction of olefinic and diolefinic unsaturation in the treated pyrolysis naphtha. Additionally, it can be seen that treating pyrolysis naphtha according to the method of the present invention substantially improves reduction of olefinic unsaturation in a subsequent hydrogenation step. From the above description and examples many modifications and variations of the process will be obvious to those skilled in the art. All such variations and modifications are considered to be included in the present invention, and no limitations other than those contained in the appended claims are intended or implied.

We claim:

1. A process for treating pyrolysis naphtha for reduction of olefinic unsaturation, which process comprises: treating pyrolysis naphtha with water in a ratio of from about 3:1 to about 0.5:1 at a temperature in the range of about 500°–700°F, at a superatmospheric pressure sufficient to maintain a substantial portion of the water in liquid phase, for a residence time of from about 12 minutes to about 10 hours in a reaction zone, and withdrawing a naphtha phase of reduced olefinic unsaturation from said reaction zone.

2. The method of claim 1 wherein the ratio of reaction zone volume to volume of liquid reactants is from about 2:1 to about 5:1.

3. The method of claim 2 wherein the treating pressure in said reaction zone is in the range of 690–4000 psig, sufficient for a substantial portion of the water to remain in the liquid phase at said treating temperature.

4. The method of claim 3 wherein the reaction temperature is about 700°F.

5. The method of claim 4 wherein the reaction residence time is from about 1 to about 10 hours.

6. The method of claim 5 wherein, upon completion of said treating step, the pyrolysis naphtha-water reaction mixture is condensed, and wherein said treated pyrolysis naphtha phase is separated from a water-phase.

7. The method of claim 6, wherein said separated water-phase is recycled to said reaction zone for contact with additional pyrolysis naphtha in the treating step of claim 1.

8. The method of claim 7, wherein said process is a batch process.

9. The method of claim 7 wherein said process is a continuous process.

10. The method of claim 1 wherein, upon completion of said treating step, the pyrolysis naphtha-water reaction mixture is condensed and settled into a treated pyrolysis naphtha phase and a water phase, and wherein said treated pyrolysis naphtha, substantially free of water, is hydrogenated with molecular hydrogen in the presence of a hydrogenation catalyst for additional saturation of olefins and diolefins remaining in the treated pyrolysis naphtha.

11. The method of claim 10 wherein the hydrogenation step comprises contacting said treated pyrolysis naphtha with about 200–3000 SCF hydrogen per bbl, at a temperature in the range of about 400°–700°F, a pressure in the range of about 200–2000 psig, and a LHSV of about 0.5–5 v/v/hr. in the presence of a hydrogenation catalyst.

12. The method of claim 11 wherein said hydrogenation catalyst is selected from the group consisting of Group VIII and Group VI-B metals of the Periodic Table of Elements, their oxides, their sulfides and mixtures thereof.

* * * * *